US005155936A

United States Patent [19]

Johnson

[11] Patent Number: 5,155,936

[45] Date of Patent: Oct. 20, 1992

[54] SLIDING PANEL SHUTTER ASSEMBLY

[76] Inventor: Daniel B. Johnson, 1139 Strongberg Ave., Arcata, Calif. 95521

[21] Appl. No.: 703,244

[22] Filed: May 20, 1991

Related U.S. Application Data

[63] Continuation-in-part of Ser. No. 432,208, Nov. 6, 1989, Pat. No. 5,016,390.

[51] Int. Cl.[5] ..... E06B 7/02

[52] U.S. Cl. ..... 49/38; 160/222; 49/354

[58] Field of Search ..... 49/38, 39, 324, 354, 49/356; 160/197, 202, 222

[56] References Cited

U.S. PATENT DOCUMENTS

| | | | |
|---|---|---|---|
| 1,812,595 | 6/1931 | Larson | 49/38 X |
| 2,250,059 | 7/1941 | Farney | 160/222 X |
| 2,322,590 | 6/1943 | Pickering et al. | 49/38 X |
| 3,094,058 | 6/1963 | O'Brien et al. | 49/38 X |
| 3,444,919 | 5/1969 | Karoll | 160/222 X |
| 4,033,073 | 7/1977 | Bogan | 49/38 |
| 5,016,390 | 5/1991 | Johnson | 49/38 |

FOREIGN PATENT DOCUMENTS 3613617 10/1987 Fed. Rep. of Germany .

*Primary Examiner*—Renee S. Luebke
*Assistant Examiner*—Jerry Redman
*Attorney, Agent, or Firm*—Baker, Maxham, Jester & Meador

[57] ABSTRACT

A shutter closure assembly for covering an opening in a building or the like comprises a stationary panel having a front face defined by a plurality of alternate vertical rails and slots, and a back face defined by a plurality of alternate horizontally extending rails and slots forming a substantially uniform array of openings throughout a major area thereof, and a moveable panel having a front face defined by a complementary plurality of horizontal rails formed by a plurality of horizontal slots, and a back face defined by a plurality of vertical rails formed by a plurality of vertical slots forming a corresponding array of openings and moveable relative to the stationary panel for alternately covering and uncovering the openings in the stationary panel.

16 Claims, 3 Drawing Sheets

SLIDING PANEL SHUTTER ASSEMBLY

REFERENCE TO RELATED APPLICATION

This is a continuation-in-part of my co-pending application Ser. No. 07/432,208, filed Nov. 6, 1989, entitled SHUTTER ASSEMBLY, now U.S. Pat. No. 5,016,390 granted May 21, 1991.

BACKGROUND OF THE INVENTION

The present invention relates to closures for window and door openings and pertains particularly to an improved shutter assembly.

Shutters of various types have been widely used for covering window openings in buildings for controlling the ingress of light and air through the window opening. Many forms of shutters are available, and each have their own advantages and disadvantages. One of the more popular types of shutters is the pivoting or hinged louvered type, wherein louvers are mounted for pivoting about a horizontal axis to control the degree of opening between the louvers.

Other pivoting louvers are available that pivot about a vertical axis. These louvered types generally have an advantage of ease of adjustment over a wide range. However, they have the disadvantages of being rather fragile and difficult to clean. They also require a large amount of space within which to pivot.

Another type of shutter is that of a sliding panel within a frame to alternately cover and uncover an opening. A typical example of this construction is disclosed in U.S. Pat. No. 4,033,073, issued Jul. 5, 1977 to Bogan. This patent discloses a ladder like fixed panel mounted within a frame structure, with a vertically moveable ladder like frame mounted within or to the first panel by a tongue and groove construction. The moveable panel is moveable vertically to provide various degrees of openings between the slots thereof and those of the fixed panel. Magnets are utilized to secure the moveable panel in its closed vertical position. Among the major problems with this construction is that it is difficult to adjust to any position between full open and full closed. Moreover, the moveable panel must be moved against its weight, and therefore must be supported by carefully selected magnets or some complex latch or other mechanism.

Another drawback to the aforementioned construction is that the tongue and groove moveable panel requires unusually accurate and precise construction. Also, it is subject to jamming due to warping, unusual wear, dirt and debris, and other factors.

Another example of the sliding panel type of shutter is illustrated in U.S. Pat. No. 1,860,648, issued May 31, 1932 to Bokan. This patent discloses a door or window closure having sliding panels, alternate screens and glass panels for converting alternately from a storm door or structure into a screen door or structure. This patent discloses both vertically slideable panels and horizontally slideable panels. These suffer from similar drawbacks to those previously described.

In the parent application, I disclose a shutter assembly wherein a front stationary panel is formed of a gridwork of openings. A horizontally sliding panel having a similar gridwork of openings is mounted behind the front panel and moveable to alternate positions of opening and blocking the openings. This assembly has the drawback of having only an open position for both air and light and a closed position for both light and air. It also sometimes has a problem of warping, particularly for larger thin panels.

It is, therefore, desirable that improved shutter assemblies be available that overcome the above problems.

SUMMARY AND OBJECTS OF THE INVENTION

It is the primary object of the present invention to provide an improved shutter assembly that overcomes the above problems of the prior art.

In accordance with a primary aspect of the present invention, a shutter assembly for a screen or an opening in a building comprises a stationary panel, defined by a plurality of cross rails and grooves forming a substantially uniform array of openings throughout a major area thereof, a first moveable panel formed of a complementary plurality of cross rails and grooves forming a corresponding array of openings, and moveable relative to the first panel for alternately covering and uncovering the openings in the first panel, and a third moveable transparent panel moveable relative to the first moveable panel, and having an array of openings alignable with the openings of the other panels to provide alternate air openings and light openings.

BRIEF DESCRIPTION OF THE DRAWING

The above and other objects and advantages of the present invention will become apparent from the following description when read in conjunction with the accompanying drawings wherein.

DETAILED DESCRIPTION OF A PREFERRED EMBODIMENT

Figure 1:
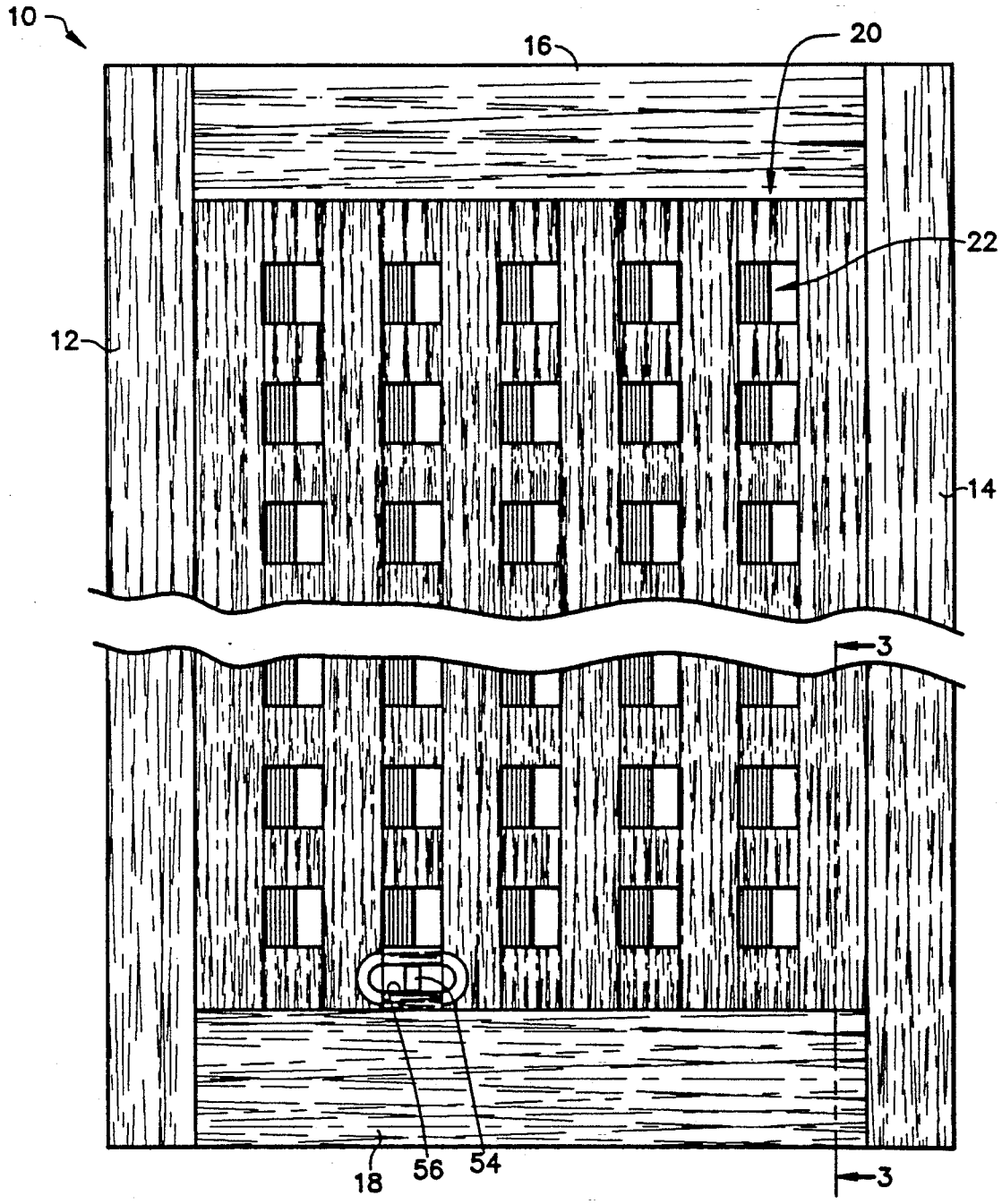
FIG. 1 is a front elevation view of a one embodiment of the invention.
Figure 2A:
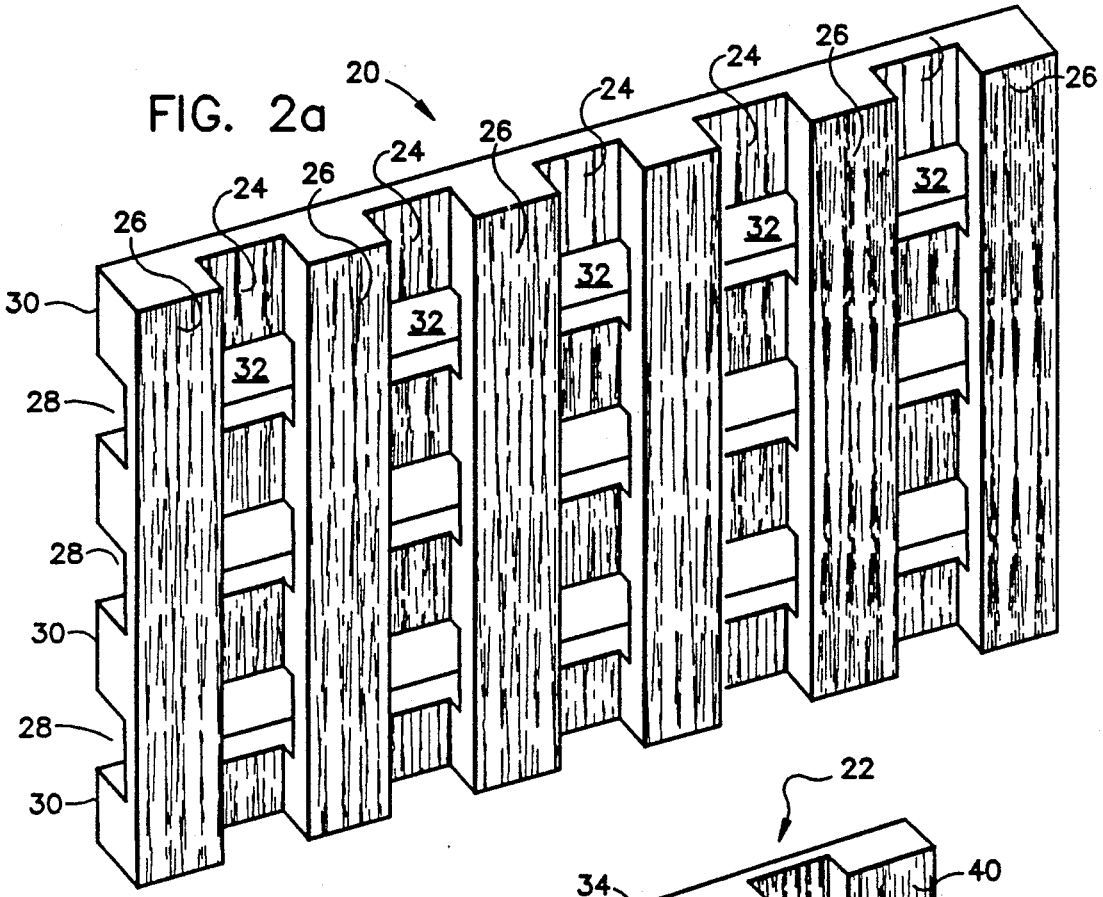
FIG. 2*a* is a perspective view showing details of the construction of the fixed panel of the embodiment of FIG. 1.
Figure 2B:
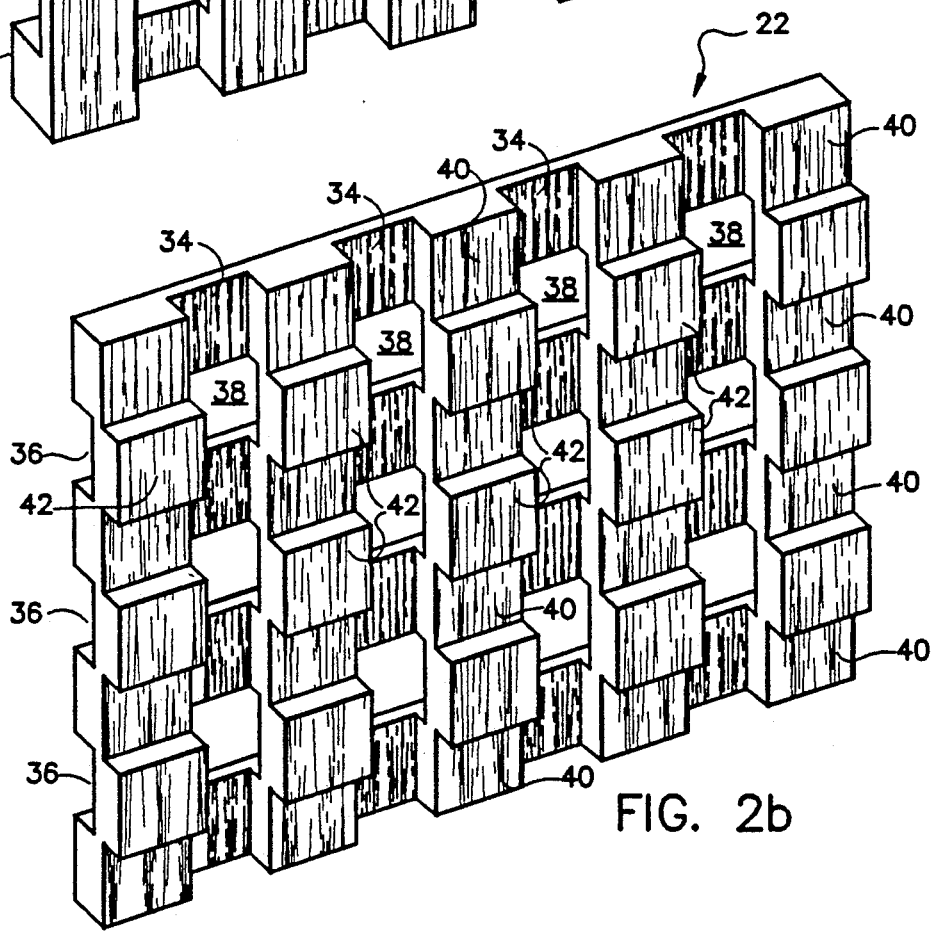
FIG. 2*b* is a perspective view showing details of the construction of the moveable panel of the embodiment of FIG. 1.

Referring now to the drawing, particularly to FIGS. 1 and 2, there is illustrated a shutter assembly constructed in accordance with a one embodiment of the invention. The shutter assembly, designated by the numeral 10, comprises a peripheral frame of a generally rectangular configuration for fitting a door or window opening or the like, and for attachment by hinges at one side to a window or door frame. The frame comprises a pair of vertical members 12 and 14 secured together at the top by horizontal frame members 16 and 18. These are secured together in a conventional fashion, such as by tongue and groove or similar joints for providing a sturdy and rigid construction. Mounted within this frame is a first or stationary panel, designated generally by the numeral 20, and further illustrated in FIG. 2*a*. Mounted directly behind the stationary panel for horizontal sliding movement is a moveable panel, designated generally by the numeral 22, and further illustrated in FIG. 2*b*.

The stationary panel 20 is preferably constructed of a unitary panel and is formed as illustrated by a plurality of vertical slots 24, forming vertical bars or rails 26 on a front face thereof. These may be formed by milling or the like as will be further explained. A plurality of horizontal slots 28 form a similar plurality of horizontally extending bars or rails 30 extending across a back face. These cross slots 24 and 28 intersect, forming a plurality of openings or windows 32. These openings or windows may be square or rectangular, but will have a uniform size, location and configuration as determined by the width of the slots and the spacing thereof.

Referring now to FIG. 2*b*, the sliding panel 22 is formed by a similar unitary panel of slightly less width than that of the stationary panel. In a preferred form, the width of the moveable panel may preferably be about two rail or slot widths less than that of the stationary panel. This provides the lateral space to slide the panel and close the openings 32 from either side of the stationary panel, and more precisely control direct and indirect lighting into and through the panel.

The moveable panel 22 is formed by means of a plurality of vertical slots 34, which are intersected by a plurality of horizontal slots 36, forming a plurality of openings 38. In addition, a plurality of horizontal slots 40 are formed on the front face of the moveable panel, thereby forming a plurality of forwardly projecting blocks or faces 42, which are complementary to the slots 28 of the fixed panel. These extend into and are moveable into position in front of the openings 32 in the fixed panel to block them. Similarly, they move to positions behind the vertical rails or bars 26 of the fixed panel to align the openings 38 in the moveable panel, with those 32 in the fixed panel to provide an opening in the shutter assembly.

While these panels are preferably formed of a unitary panel of wood milled into the above described configuration by the cross cutting of grooves, they can be constructed by other means and from other materials. For example, they may be formed by injection molding of plastic panels. The panels need only have sufficient thickness to provide sufficient strength and rigidity for the panel support.

The panels may also actually be constructed of strips of wood or the like of uniform width and spacings secured together in the appropriate configuration. While the strips or rails and slots are described as being of substantially the same width, they are in actuality sufficiently different that the appropriate cooperative interrelationship is achieved. The bars or rails, for example, must be of a slightly less width than the slots to be slideable therein, and to enable the panels to move freely relative to one another.

Referring now to FIG. of the 3 the drawing, there is illustrated a shutter assembly constructed in accordance with an alternate embodiment of the invention. This shutter assembly may be referred to as a sandwich assembly, because a first moveable panel is sandwiched between a pair of stationary panels, and a second moveable panel is sandwiched within the first moveable panel. This assembly is mountable within a peripheral frame of a generally rectangular configuration as in the FIG. 1 embodiment. Mounted within this frame is a pair of identical opposed stationary panels, like that designated generally by the numeral 20 in FIG. 1, and further illustrated in FIG. 2*a*. One of these panels is preferably fixed within the frame and the other removeably mounted, such as by means of spring plunger sets, wherein a plunger in either the panel or frame is biased by a spring into a bore in the other one of the panel and frame.

Mounted between the opposed stationary panels for horizontal sliding movement is a moveable split or double panel, formed by a pair of opposed identical panels, designated generally by the numeral 44. These are disposed in opposed face to face relation, and secured together by spacer strips to provide a space therebetween. A transparent panel, designated generally by the numeral 46, is slideably mounted within the space provided within the double panel.

The panel 44 of the double moveable panel is preferably constructed of a unitary thin flat panel 48, having a plurality of openings 50 corresponding in size to openings 32 of panel 20. A plurality of blocks 52 are formed or mounted on a front face of the panel 48. These blocks 52 extend into slots 28 of panel 20 and also correspond in size and spacing to openings 32. A pair of these panels 44 are positioned in back to back relationship, and secured together in spaced relationship by upper and lower spacer bars or strips 58, providing a space for slideably receiving panel 46. Panel 46 is formed of a suitable transparent material, such as a plastic, with a plurality of square or rectangular windows 60 corresponding in size and spacing to windows 32. These openings or windows may be square or rectangular, but will have a uniform size, spacing and configuration as determined by the slots and the spacing thereof formed in the stationary face panels 20.

Figure 3:
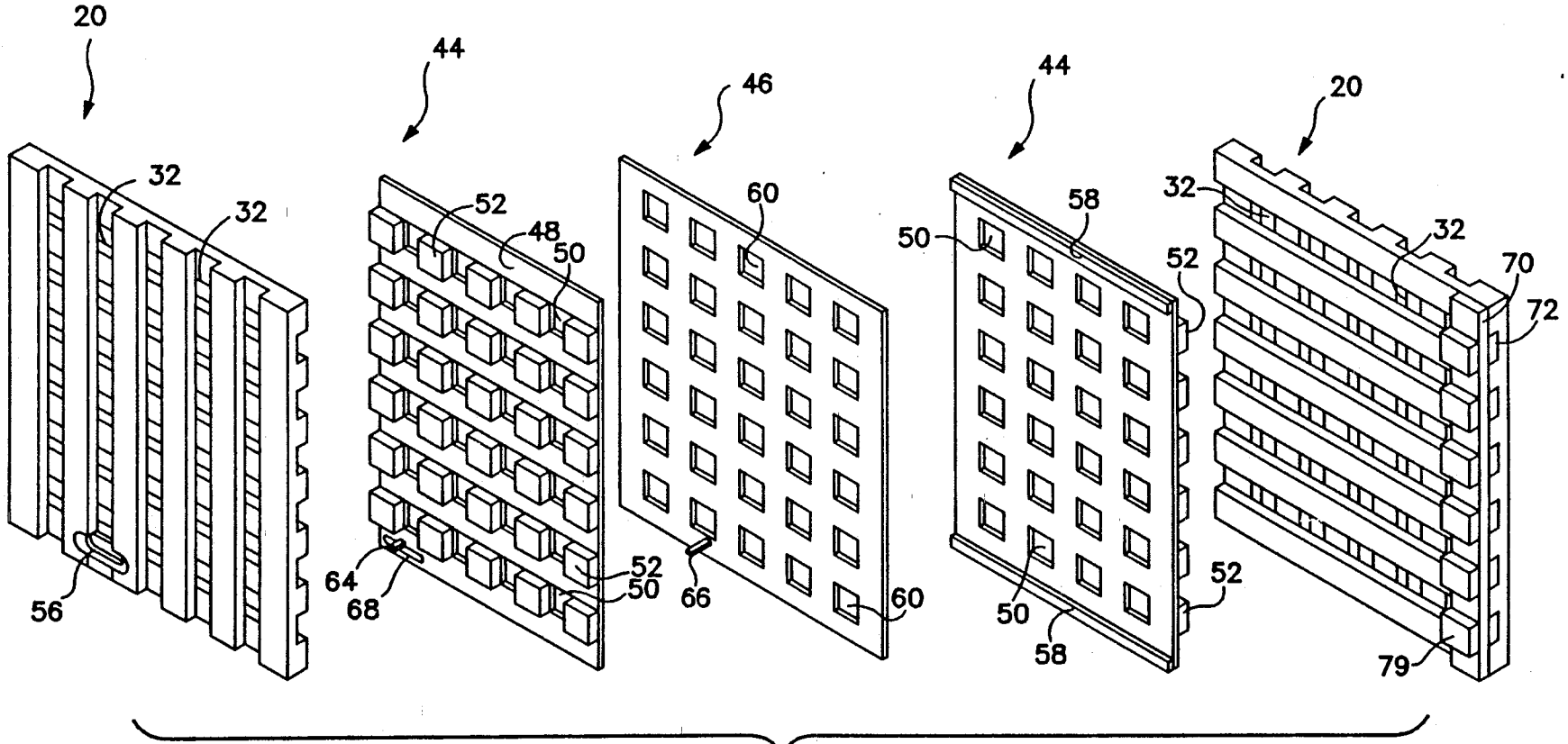
FIG. 3 is a perspective view of an alternate embodiment showing details of the construction and relationship of the fixed panels and the moveable panels.

The sliding double panel 44 is preferably mounted in the frame 12, 14, 16, 18 by means of balls and grooves, as in FIGS. 3 and 4 of the parent application (U.S. Pat. No. 5,016,390), the full disclosure of which is incorporated herein as though fully set forth. The sliding transparent panel 46 is also mounted in the panel in a similar manner. This combination provides the ability to close the openings 32 by means of movement of panel 44 to position blocks 52 in front of openings 32. This closes the shutter assembly to both light and air. The shutter assembly may be open to both light and flow of air by moving panels 44 and 46 to align openings or windows 50 and 60 with windows 32 of the face panel 20. The shutter assembly may be closed to air but open to light by aligning opening 50 and 32 with non-alignment of windows 60, i.e., an intermediate portion of the transparent panel.

A seal block assembly includes a central strip 70 having a thickness equal to or slightly greater than the combined panels 44 and 46. This central strip includes a plurality of blocks 72 on one face and 76 on the other face, for extending into the transverse slots in the opposed faces of panels 20 for the sliding panels 44 and 46 to seal against when in the closed position.

The sliding panels 44 and 46 may be actuated directly by means of a tab 64, which is connected directly to the slideable panel 44, and a tab 66 connected directly to panel 46. These tabs extend into and through a slot 56 in the front of the stationary panel 20. The tab 66 extends through slot 68 in the front one of panel 44 and then through slot 56. Thus, the double panel 44 and the transparent panel 46 can be shifted independently of one another.

An alternate form of actuator, which includes linkage means for applying a force to the upper and lower ends of the slideable panel for panels of substantial height, is illustrated for example in FIG. 5 of the parent U.S. patent.

While I have illustrated and described my invention by means of specific embodiments, it is to be understood that numerous changes and modifications may be made therein without departing from the spirit and scope of the invention as defined in the appended claims. I further assert and sincerely believe that the above specification contains a written description of the invention and the manner and process of making and using it, in such full, clear, concise, and exact terms as to enable any person skilled in the art to which it pertains, or with which it is most nearly concerned, to make and use the same, and further that it sets forth the best mode contemplated by me for carrying out the invention.

I claim:

1. A shutter closure for an opening in a building comprising:

a pair of substantially identical stationary panels, each defined by a plurality of cross rails forming a substantially uniform array of openings throughout a major area thereof, said panels disposed in spaced opposed relation, said stationary panels each having a front and a back, said front defined by a plurality of alternate vertically extending rails and slots, and said back is defined by a plurality of alternate horizontally extending rails and slots, said openings are formed by intersection of said slots; and a first moveable panel formed of a planar panel having a corresponding uniform array of openings disposed between and moveable transversely relative to said stationary panels for alternately covering and uncovering said openings in said stationary panel, said moveable panel having a front and a back and a plurality of horizontally arranged blocks extending forwardly into said horizontally extending slots and moveable to positions for blocking said openings in said stationary panels.

2. A shutter closure according to claim 1 wherein said openings are square and of a uniform size.

3. A shutter closure according to claim 1 wherein said openings are rectangular and of a uniform size.

4. A shutter closure according to claim 1 wherein said rails and said slots are of substantially identical width.

5. A shutter closure according to claim 1 wherein said stationary panels are each made from a unitary structure, and said rails are defined by spaced vertical slots on a front face and horizontal slots on a back face, and said openings are defined by intersection of said vertical slots with said horizontal slots.

6. A shutter closure according to claim 1 wherein:

said stationary panels are secured in a peripheral frame; and said first moveable panel is moveably supported in said frame.

7. A shutter closure according to claim 6 further comprising a transparent moveable panel disposed between said opposed panels of said first moveable panel and having an array of openings corresponding in size and spacing to the array of openings in said first moveable panel for selective alignment therewith.

8. A shutter closure according to claim 7 wherein:

said stationary panel and said first moveable panel are each made from a unitary structure, and said rails are defined by spaced vertical slots cut into a front face and horizontal slots cut into a back face and said openings are defined by intersection of said vertical slots with said horizontal slots.

9. A shutter closure according to claim wherein:

said first moveable panel comprises a pair of spaced apart opposed panels having an array of openings corresponding in size and spacing to the array of openings in said stationary panels, and an array of blocks corresponding in size and spacing to the array of openings in said stationary panels so that said first moveable panel is moveable to selective positions of alignment of said array of openings and of said blocks with said array of openings in said stationary panels.

10. A shutter closure for covering an opening in a building comprising:

a stationary panel assembly comprising a first panel having a front face defined by a plurality of alternate vertical rails and slots, and a back face defined by a plurality of alternate horizontally extending rails and slots forming a substantially uniform array of openings at an intersection of said vertically extending slots and said horizontally extending slots throughout a major area thereof, and a second stationary panel being a substantially mirror image of said first panel disposed in spaced opposed relation to said first panel; and a moveable panel assembly comprising a first moveable panel disposed between said first and second stationary panels and having an array of openings corresponding to said array of openings in said stationary panel and a corresponding array of blocks disposed between said openings and extending from opposite faces of said moveable panel assembly into said horizontally extending slots, and said moveable panel assembly moveable transversely relative to said stationary panel for alternately covering and uncovering said openings in said first stationary panel.

11. A shutter closure according to claim 10 wherein:

said first moveable panel assembly comprises a pair of spaced apart opposed panels having an array of openings corresponding in size and spacing to the array of openings in said stationary panels, and an array of blocks corresponding in size and spacing to the array of openings in said stationary panels so that said first moveable panel assembly is moveable to selective positions of alignment of said array of openings and of said blocks with said array of openings in said stationary panels.

12. A shutter closure according to claim 11 wherein said first moveable panel assembly comprises a transparent moveable panel disposed between said opposed panels of said first moveable panel assembly and having an array of openings corresponding in size and spacing to the array of openings in said first moveable panel for selective alignment therewith.

13. A shutter closure according to claim 12 wherein said openings are square and of a uniform size.

14. A shutter closure according to claim 12 wherein said openings are rectangular and of a uniform size.

15. A shutter closure according to claim 12 wherein said rails and said slots are of substantially identical width.

16. A shutter closure assembly for covering an opening in a building comprising:

a stationary panel assembly comprising a pair of substantially identical stationary panels disposed in spaced opposed relation, each defined by a plurality of cross rails forming a substantially uniform array of openings throughout a major area thereof; and a moveable panel assembly comprising a pair of spaced apart opposed moveable panels having an array of openings corresponding in size and spacing to the array of openings in said stationary panels, and an array of blocks corresponding in size and spacing to the array of openings in said stationary panels so that said pair of moveable panels are moveable to selective positions of alignment of said array of openings and of said blocks with said array of openings in said stationary panel, a transparent independently moveable panel disposed between said pair of opposed moveable panels and having an array of openings corresponding in size and spacing to the array of openings in said first moveable panel for selective alignment therewith for providing alternate air and light openings.

* * * * *